United States Patent [19]

Lynch

[11] Patent Number: 4,779,635

[45] Date of Patent: Oct. 25, 1988

[54] COLLAPSIBLE CANOPY WITH TELESCOPING ROOF SUPPORT STRUCTURE

[76] Inventor: James P. Lynch, 13 South Field, Lakewood, Colo. 80226

[21] Appl. No.: 89,441

[22] Filed: Aug. 26, 1987

[51] Int. Cl.[4] ..... E04H 15/18; E04H 15/50

[52] U.S. Cl. ..... 135/97; 135/110; 52/109

[58] Field of Search ..... 135/103, 97, 106, 98, 135/107, 108, 109, 110, 111, 112, 113; 52/109

[56] References Cited

U.S. PATENT DOCUMENTS

| | | | |
|---|---|---|---|
| 684,130 | 10/1901 | Taubert | 135/110 |
| 1,326,006 | 12/1919 | Sterhardt | 135/109 |
| 1,493,915 | 5/1924 | Baker | 135/109 |
| 1,712,836 | 5/1929 | Mills | 135/110 |
| 1,728,356 | 9/1929 | Morgan | 135/109 |
| 1,853,367 | 4/1932 | Mace | 135/110 |
| 2,135,961 | 11/1938 | Chemoweth | 135/109 |
| 2,440,557 | 4/1948 | Power | 135/90 |
| 2,770,243 | 11/1956 | Miller | 135/109 |
| 2,928,404 | 3/1960 | Klages | 135/109 |
| 3,174,397 | 3/1965 | Sandborn | 52/109 |
| 3,199,518 | 8/1965 | Glidewell | 135/109 |
| 3,335,815 | 8/1967 | Oakes | 52/109 |
| 3,375,625 | 4/1968 | Mikulin | 52/109 |
| 3,496,687 | 2/1970 | Greenberg et al. | 52/109 |
| 3,526,066 | 9/1970 | Hagar et al. | 52/27 |
| 4,156,433 | 5/1979 | Beaulieu | 52/109 |
| 4,607,656 | 8/1986 | Carter | 135/110 |
| 4,641,676 | 2/1987 | Lynch | 135/110 |

FOREIGN PATENT DOCUMENTS

| | | | |
|---|---|---|---|
| 15851 | of 1886 | United Kingdom | 135/111 |
| 656361 | 8/1951 | United Kingdom | 135/97 |

*Primary Examiner*—J. Karl Bell

*Attorney, Agent, or Firm*—Timothy J. Martin; J. Preston Oxenham

[57] ABSTRACT

A canopy structure is provided and includes a framework unit and a flexible covering. The framework unit is formed by a plurality of upright corner members and a plurality of roof support members that are pivotally connected at the top ends of the corner members and, in an erected position, extend upwardly and inwardly to a central apex where they are pivotally connected to one another. The roof support members are formed of extendable sections which preferably telescope with respect to one another so that the framework unit may move into a collapsed state with the corner support and roof support members oriented in closely spaced, parallel relation. Latches are provided to prevent the framework unit from collapsing from the erected position. Constraining and support structure, preferably in the form of scissor assemblies, interconnect adjacent corner support members to prevent them from moving apart past the erect state. The scissor assemblies have one portion pivotally connected to the tops of its associated corner supports and another portion pivotally connected to slide brackets on its associated corner support member. A cantilever member interconnects each roof support member and the slide bracket on its associated corner support member. The central apex may include a spring biased central post to support the peak of the covering placed on the framework unit. Several framework units may be formed together into a larger canopy structure.

34 Claims, 4 Drawing Sheets

COLLAPSIBLE CANOPY WITH TELESCOPING ROOF SUPPORT STRUCTURE

FIELD OF THE INVENTION

The present invention relates to a collapsible canopy structure which is readily portable so it may used as a convenient shade screen or shelter, primarily for outdoor activities. As such, the present invention is directed to temporary shelters which may be stored in a collapsed state which may be used in an expanded state to provide a shelter having a large surface area of protection. The present invention specifically is directed to such shelter which includes a self-contained roof support structure that telescopically expands with the remaining support framework. As such, this invention is believed to be an improvement over my U.S. Pat. No. 4,641,676 issued 10 Feb. 1987 and entitled Collapsible Canopy Structure.

BACKGROUND OF THE INVENTION

As was discussed in the background of U.S. Pat. No. 4,641,676, portable shelters have been in existence since prehistoric time, but modern times have seen an increasing need for greater sophistication in the quality and type of construction in portable shelter apparatus. In the last 20 years, this industry has dramatically grown as a result of new techonologies in fabrics, support structure and design, especially in the fields of lightweight tents and mountaineering shelters. These developments manifest themselves in special application fields, but relatively little attention has been paid to the development of larger area shelters that are stored in a small collapsed state but which may be expanded with a minimum amount of effort into sturdy, large area shelters.

One response to this need is shown in my U.S. Pat. No. 4,641,676. This patent shows a portable canopy structure having a framework that may be collapsed into a stored state yet which may be expanded and erected for use. The framework includes a plurality of upright support members which are interconnected by a plurality of scissor assemblies; an internal scissor assembly is provided to support a central post, and a covering extends across the tops of the supports and is supported thereon in a dome-like manner. This structure is also similar to that described in U.S. Pat. No. 4,607,656 issued 26 Aug. 1986, to Carter.

While the structure shown in the Lynch patent and the Carter patent provides significant advantages over the earlier prior art noted above, especially in the relative ease of both expansion and collapse, they nonetheless have some drawbacks. For example, in use, the scissor assemblies shown in these two structures are under compressive forces. When the scissor assemblies are subjected to forces transversely of their plane, the combination of this force with the compressive force can result in substantial bowing of the scissor assemblies and distortion of the canopy framework. Additionally, the use of a central scissor assembly extending across the middle of the framework can be inconvenient in reducing the head room provided for persons sheltered by the canopy structure.

In addition to the structure shown in the Lynch patent and the Carter patent described above, other prior art structures have been developed to provide temporary shelters. For example, French Patent No. 823,693 issued to Boeuf and published 25 Jan. 1938 shows a framework for supporting a shelter wherein the framework has a plurality of upright posts which are interconnected by single scissor assemblies. A plurality of roof support elements are then bolted to each upright posts and are then secured together by means of a central wing-nut assembly to define a peak for the framework. U.S. Pat. No. 2,928,404 discloses a collapsible shelter wherein upright posts pivotally secure rigid roof support elements so that the structure may fold together.

Accordingly, despite the advances of the abovedecsribed canopy structures, there remains a need for further improved canopy structure which provides a quick erectable temporary shelter which is easy to expand for use and to collapse for storage in a fast, efficient manner. There is a further need for such an improved canopy structure which increases the mechanical strength of the framework and which provides greater head room thereby more efficiently using space.

SUMMARY OF THE INVENTION

It is an object of the present invention to provide a new and useful canopy shelter which can be collapsed for compact storage yet quickly and easily erected for use.

Another object of the present invention is to provide a collapsible canopy structure complete with a folding roof support structure that extends upwardly and inwardly of the corners of the canopy framework unit to an apex portion.

A still further object of the present invention is to provide a canopy structure that has increased head room.

Yet a further object of the present invention is to provide a canopy structure that outwardly biases its corner support members so that the framework interconnecting adjacent corner support members is placed in tension rather than compression.

It is a still further object of the present invention to provide a spring biased roof support structure for a canopy framework in order to maintain the canopy covering in a taut manner at all times.

The canopy structure according to the present invention accordingly comprises a canopy framework unit that mounts a canopy top in order to provide a temporary shelter. The framework unit is readily collapsible for storage yet expandable for erection. The framework unit includes a plurality of upright corner support members each of which having a bottom end which is positionable upon a support surface, such as the ground, a floor and the like, and a top end opposite the bottom end. These corner support members are oriented alongside one another in the collapsed state and are moved outwardly apart from one another in the expanded state.

A plurality of roof support members are pivotally connected to one another on first pivot axes at first ends thereof to define an apex located centrally of the canopy framework unit. The roof support members then project radially outwardly from the apex, preferably at equiangular locations and terminate at second ends which are each pivotally connected on a second pivot axis to the top end of a respective corner support member. Each corner support member and its associated roof support member thus may be folded about the second pivot axis into the collapsed state with the roof support members simultaneously being folded about the first pivot axes so that all of the roof support members and the corner support members may be oriented in closely spaced relation to one another.

Each roof support member includes a pair of extendable sections which are moveable between a retracted state and when the canopy is in the collapsed state and an extended state when the canopy is in the expanded state. The resultant roof support members are sized such that the apex is located above a plane defined by the top ends when the canopy structure is in the expanded state and when the roof support structures are in the extended state with the roof support members being oriented at an acute angle, preferably in the range of 15° to 45°, with respect to the plane.

Constraining and support means is provided for preventing relative outward movement of the corner members past the expanded state and for maintaining lateral stability of the corner support members when they are in the expanded state. Latch means are associated with each of the roof support members to releaseably retain the extendable sections in the extended state to prevent unwanted folding of the canopy structure into the collapsed state when so latched, that any downward force exerted on the apex exerts an outward force component tending to move the corner support members apart from one another against the constraining means.

A flexible covering is then sized to extend across and be supported by the roof support members to form a top for the canopy structure. The covering has perimeter edge portions extending between top ends of adjacent ones of the corner support members and a central peak portion which exerts a downward force on the apex when the covering is mounted on the canopy framework unit.

In the preferred form of the present invention, the constraining means is defined by framework structure which extends between the top end portions of adjacent corner support members. This framework structure is formed by a scissor assembly having one portion which is pivotally connected to a top end of its associated corner support member and another portion pivotally connected to a slide bracket mounted on its associated corner support members. The scissor assemblies operate to open and close as the corner support members are moved between the expanded and collapsed states.

To further support the roof structure, a cantilever member preferably extends between each slide bracket and the roof support member which is associated with a respective corner support member slideably supporting the slide bracket. To this end, also, each roof support member preferably comprises at least two telescoping sections, an inner telescoping section mounted to the apex portion and an outer telescoping portion mounted to a respective corner support member and telescopically receiving the inner telescoping mamber. The latch means is then conveniently a button latch between these two telescoping sections.

The apex portion of the framework unit preferably includes a central post assembly that may be spring loaded so that it is upwardly biased against the central portion of the canopy covering. Further, an upper end of the central post assembly may terminate in a dome element thereby increasing the surface area of contact between the post assembly and the covering.

To accommodate the dimension of the slide bracket as well as the dome-ended central post, each roof support member is provided with a double dog leg construction. A first dog leg is located adjacent the apex such that the roof support members may be folded alongside and parallel one another around the dome element when the canopy structure is folded into the collapsed state. Likewise, the second end of each roof support member has a dog leg whereby each corner support member and its associated cantilever member and roof support member can be folded in closely spaced parallel relation to one another in the collapsed state.

Preferably, the flexible covering include side panels that extend downwardly from the perimeter edge portion so that adjacent ones of the side panel portions have vertical edges are attached to one another to form corner pocket regions that receive top end portions of the corner support members. These sprocket regions may be provided with releaseable securing means, such as Velcro strips, which cooperate with corresponding means on the top end portion to further secure the covering to each corner support member. The covering is preferably formed of a polyester material, but other suitable fabrics may be used as well. If desired, a plurality of canopy framework units may be constrcted together to form a larger framework structure that is then covered by a larger covering having multiple peaks.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed toward a quick erectable canopy structure which includes a canopy covering and a canopy framework unit which is adapted to mount and position the canopy covering as a temporary shelter. Thus, the present invention is useful in creating a canopy assembly that may be stored in a compact, collapsed state yet which may be quickly and easily erected in an expanded state so that the canopy covering shelters a large surface area which provides shade and/or protection against rain.

Figure 1:
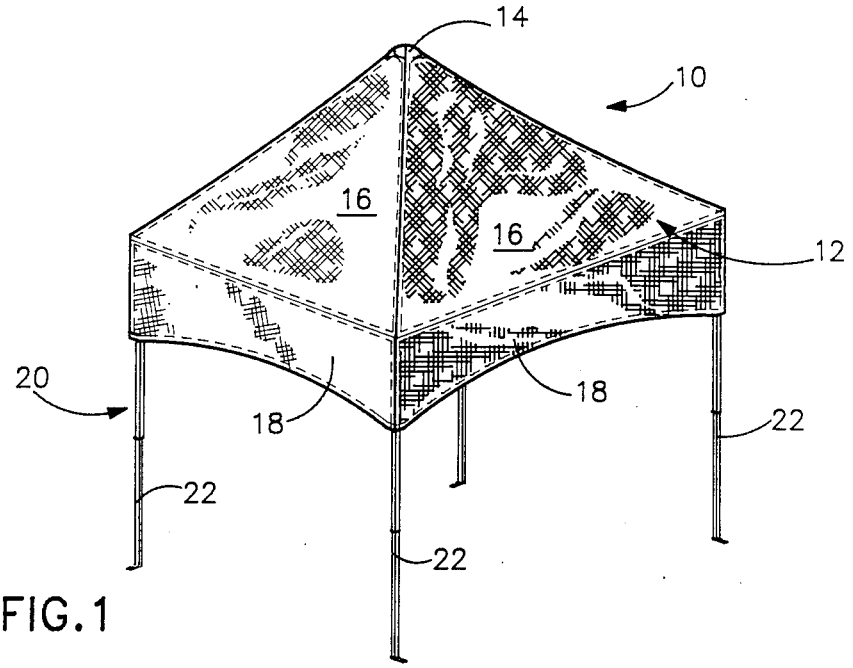
FIG. 1 is a perspective view of a canopy structure according to the preferred embodiment of the present invention.

As is shown in FIG. 1, then, canopy structure 10 is shown in the expanded state and broadly includes a canopy covering 12 and a canopy framework 20. Canopy covering 12 has a central peak 14, and it is formed of top panels 16 and side panels 18. Covering 12 is supported by a canopy framework unit 20 which includes a plurality of corner support members 22. In FIG. 1, the canopy structure is shown in the expanded state.

Figure 2:
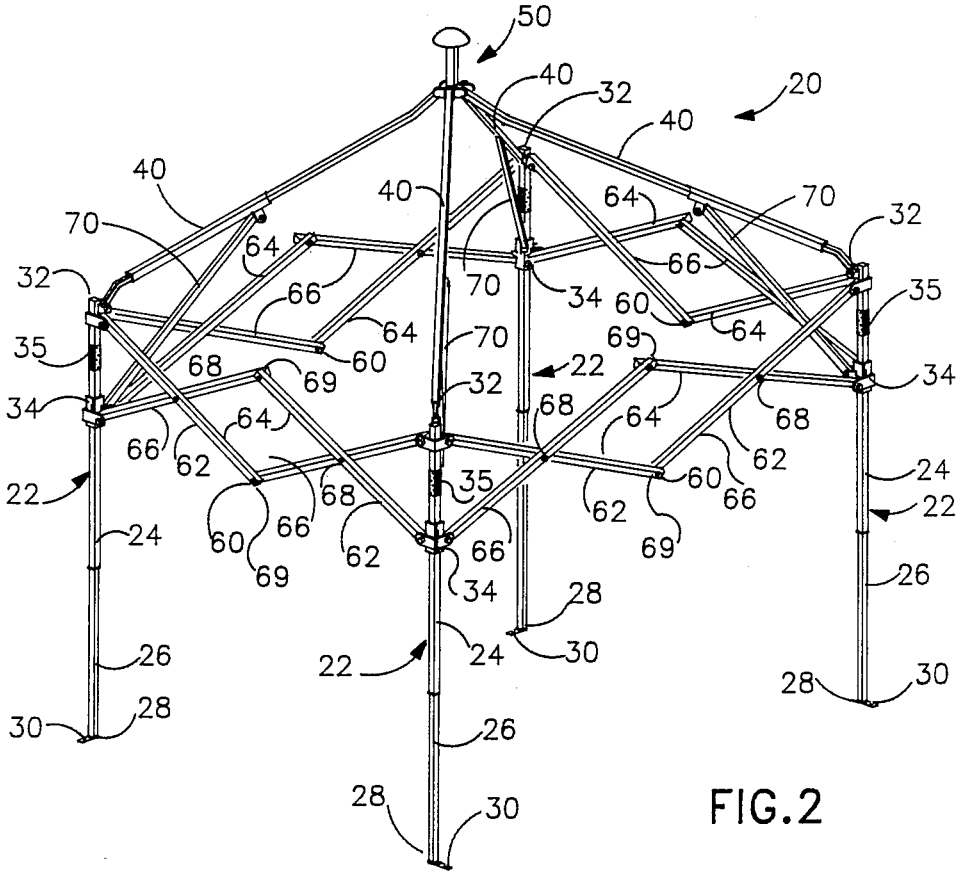
FIG. 2 is a perspective view of the structural framework unit for the canopy structure shown in FIG. 1.
Figure 3:
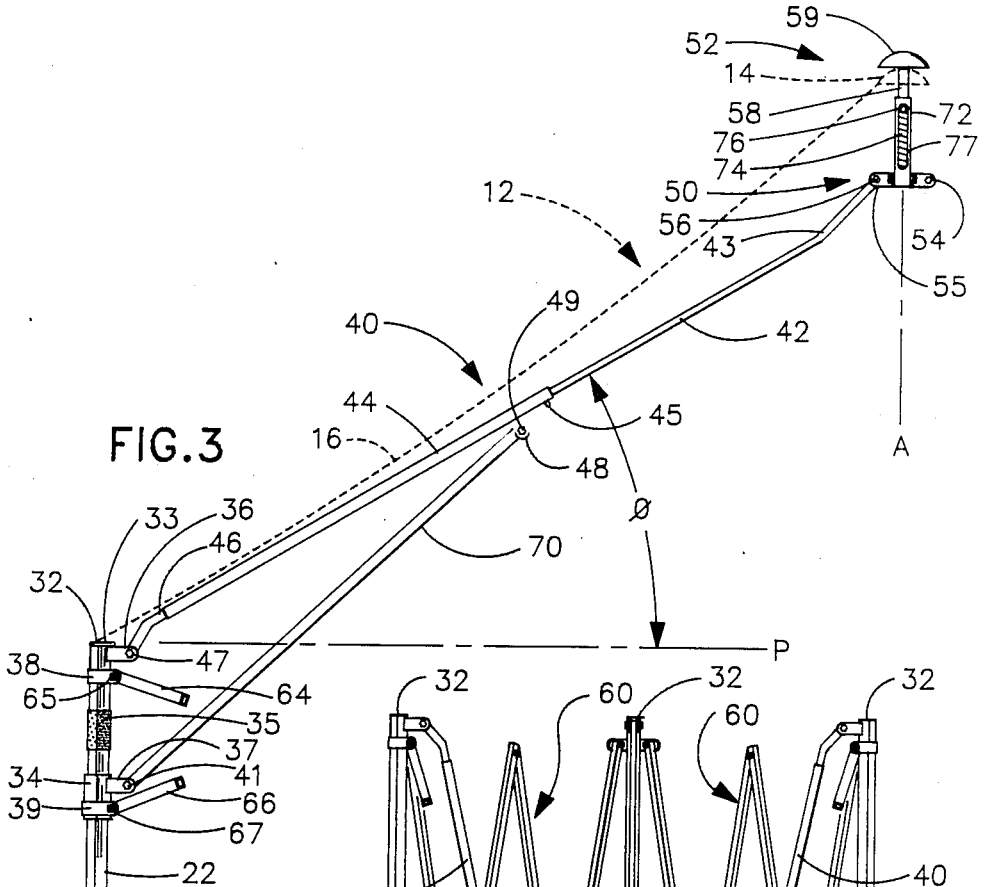
FIG. 3 is a side view in elevation of a top portion of a representative corner support member and roof support member which forms the canopy framework unit shown in FIG. 2.

The construction of canopy framework unit 20 is best understood with reference to FIGS. 2 and 3. As is shown in these figures, canopy framework unit 20 includes four corner support members 22, each of which is constructed of an upper telescoping member 24 and a lower telescoping member 26 which may be latched in selected relative extensions by button latches 27, shown in FIG. 4, as is known in the art. Each of members 24 and 26 is preferably a tube having square-shaped cross section. Corner support members 22 accordingly define the edges of a geometrical configuration for the canopy structure. Thus, while it should be appreciated that FIGS. 1 through 6 describe a canopy having a generally cubic construction, other geometric configurations are within the scope of this invention. Canopy framework unit 20 is adapted to rest on a support surface. Accordingly, each corner support member 22 terminates in a foot 30 located at bottom end 28. Foot 30 rests on the support surface with each corner support member 22 being oriented in a generally upright, vertical position with respect to the support surface.

A plurality of roof support members 40 are provided, with each roof support member 40 extending from an upper end 32 of a respective corner post to terminate at an apex portion 50. Each adjacent corner support member 22 is interconnected to another by constraining and support means in the form of a scissor assembly 60 which is oriented in a vertical plane and comprises a pair of scissor units 62 connected in end-to-end relation. Each scissor unit 62 is formed by first and second cross pieces 64 and 66 which are pivotally connected to each other about their midpoints. An upper portion of each scissor assembly 60 is connected to each of its corner support members 22 at the top ends 32 thereof. Further, a lower portion of each scissor assembly 60 is connected to a slide bracket 34 which is slideably received on each respective corner post 22. A cantilever member 70 extends between each slide bracket 34 and an associated roof support member 40, as more thoroughly described below.

Each set consisting of a corner support member 22 and a corresponding roof support member 40 are constructed identically. Thus, for purposes of explanation, the description of a single such assembly may best be made with reference to FIG. 3. In this figure, the top end 32 of a corner support member 22 is shown and is closed by a plastic end cap 33. A U-bracket 36 is mounted to corner support member 22 at top end 32 and a first L-bracket 38 is attached to corner support member 22 adjacent U-bracket 36. A slide bracket 34 is slideably received on corner support member 22 and both a second U-bracket 37 and a second L-bracket 39 is attached to slide bracket 34. As noted above, cross pieces 64 and 66 of a scissor unit 62 are pivotally connected to L-brackets 38 and 39 by pins 65 and 67, respectively.

Roof support member 40 is formed of a pair of extendable members, preferably in the form of an inner telescoping member 42 and an outer telescoping member 44 which telescopically receives member 42. Roof support member 40 projects radially inwardly to apex portion 50 so that an inner or a first end of roof support member 40 is pivotally secured to the apex portion, as described below. An outer or second end of roof support member 40 is formed by means of a lower dog leg arm 46 that is received in and affixed to outer telescoping section 44. The other end of arm 46 is pivotally secured to U-bracket 36 by means of a pin 47.

At its ends opposite arms 46, outer telescoping member 44 has a downwardly projecting U-bracket 48. Cantilever member 70 is pivotally connected at one end to U-bracket 48 by pin 49 and at the other end to U-bracket 37 by means of pin 41. Thus, it should be appreciated that roof support member 40 may pivot downwardly with respect to corner support member 22 about pin 47. When this happens, slide bracket 47 moves downwardly and, accordingly, cantilever member 70 scissors so that roof support member 40 is oriented in closely spaced parallel relation alongside corner support member 22. It should be appreciated that lower dog leg arm 46 is provided to establish an offset to accommodate the width of U-brackets 37 and the width of cantilever member 70 between roof support member 40 and corner support member 22. To maintain telescoping members 42 and 44 in the extended position, shown in FIG. 3, a latch means in the form of button latch and mating hole structure 45 is provided with the button latch 45 being located on one of the telescoping sections and the hole being located on the other telescoping section, as is standard construction known in the art.

As noted above, apex portion 50 is located at an end of roof support member 40 opposite corner support member 22. Apex portion 50 includes a center post assembly 52 which includes a cross bracket 54 that provides four pairs of ears, such as ears 55. The end of inner telescoping member 42 of roof support member 40 is thus pivotally connected between a pair of ears 55 by means of a pin 56, with this end terminating in an upper dog leg portion 43. Center post assembly 52 includes a post or upper member 58 that has a dome-shaped head 59. Upper member 58 is telescopically received in a lower member 72 that forms a housing for upper member 58 which is upwardly and outwardly biased by means of a spring 74; however, member 58 includes as post 76 received in slot 77 to prevent removal from member 72.

It should be appreciated from the foregoing that central post assembly 52 is vertically positioned along a central axis A which is vertical to the support surface. Each of upper ends 32 of corner support members 22 terminate in a common plane P which is transverse to axis A. In the preferred embodiment, in the expanded state shown in FIGS. 2 and 3, each of roof support members 40 are sized so that the apex portion 50 is located above plane P such that roof support members are oriented at an acute angle $\phi$ with respect to plane P. Preferably, this acute angle is in a range of 15° to 45°, inclusive, and it has been found particularly useful to select angle $\phi$ to be 30°.

As is shown in phantom in FIG. 3, canopy covering 12 has a side panel 18 which is additionally secured to a top portion of corner support member 22 by means of corresponding hook and loop fasteners, such as Velcro fasteners 35. Covering 12 then extends over upper end 32 of corner support member 22 such that its top panel 16 extends upwardly to peak 14 that is defined by head 59 of corner post assembly 52. It should be appreciated that the restorative biasing of upper member 58 causes head 59 to maintain tension on canopy covering 12 so that top panels 16 are maintained in a taut condition regardless of environmental conditions. Furthermore, the covering 12 also acts as constraining means to prevent over expansion of the canopy framework unit 20.

The expansion and contraction of canopy structure 10 can now be more fully appreciated with reference to FIGS. 2–5. When, in the erect or expanded state, shown in FIGS. 2 and 3, each of scissor assemblies 60 are in the full open position and telescoping members 42 and 44 are in the fully extended position and latched by means of the button latch 45. In this position, roof support member 40 is oriented at acute angle $\phi$ with respect to plane P. When the user desires to collapse canopy structure 10, the user depresses each of button latches 45 so that each of inner telescoping members 42 may slide into outer telescoping member 44. Once released, each roof support member 40 may pivot downwardly toward the respective corner support member 22. Due to the inner connection of cantilever 70 with slide bracket 34, slide bracket 34 moves downwardly towards bottom end 28 of corner support member 22. Since slide bracket 34 is connected to a lower portion of scissor assembly 60 at L-bracket 39, this causes each scissor assembly 60 to close. In order to accommodate this, each of scissor units 62 are pivotally secured at their centers and to each other at connections 68 and 69, respectively, as is shown in FIG. 2.

Figure 4:
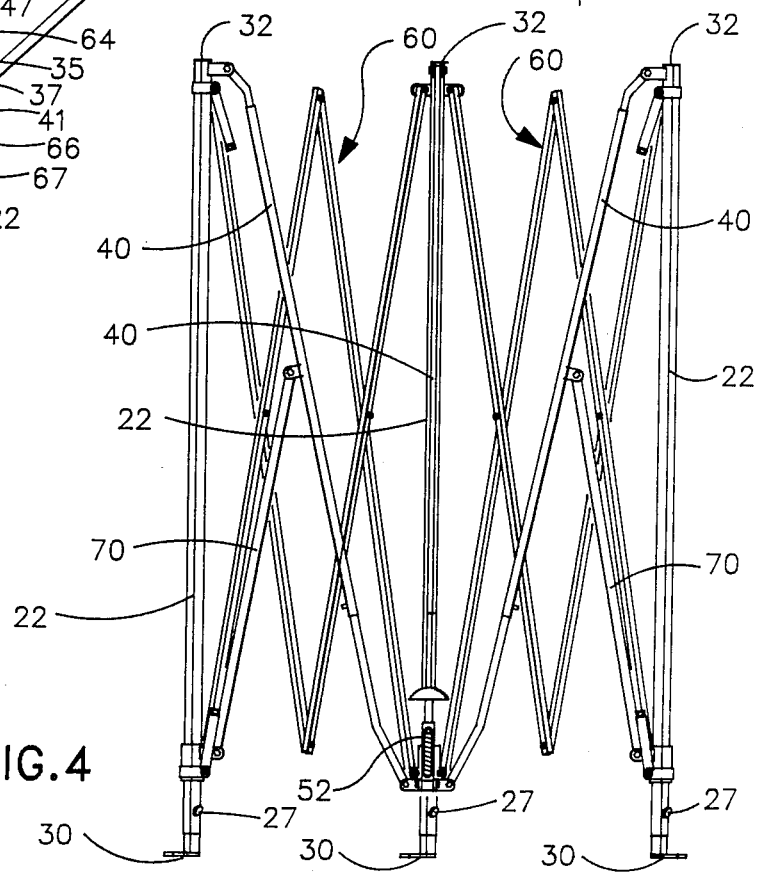
FIG. 4 is a side view in elevation of the framework unit shown in FIG. 2 approximately half way between the expanded state and the collapsed state.
Figure 5:
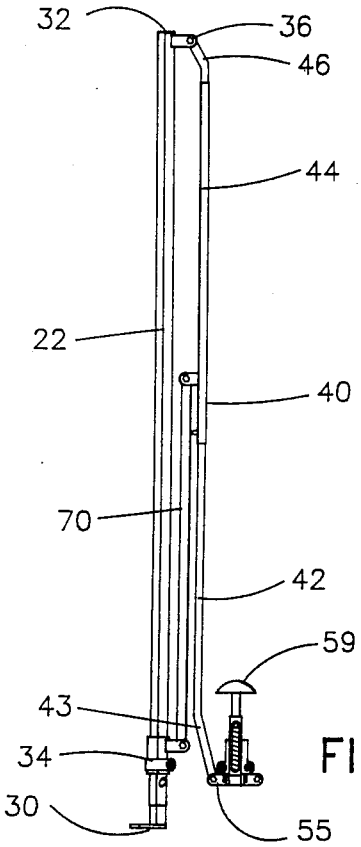
FIG. 5 shows a single corner support member and roof support member in the collapsed state.
Figure 6:
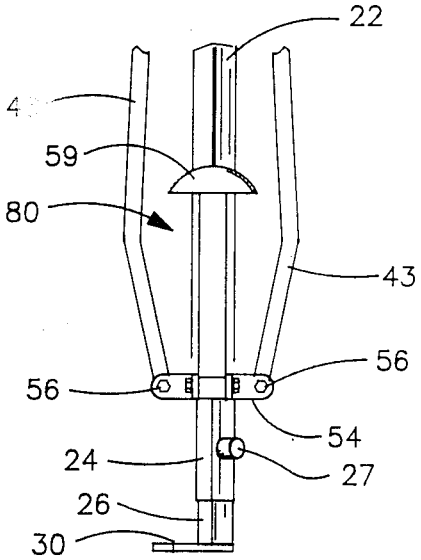
FIG. 6 is a side view in elevation showing the central post in a collapsed state.

As this downward or "collapsing" motion continues, canopy structure 10 is moved into the position shown in FIG. 4. In this intermediate position, center post assembly 52 is adjacent plane Q of bottom ends 28 of corner support members 22 with each corner support member 22 and its respective roof support member 40 and cantilever member 70 being in a folded position. Corner support members 22 are then moved towards one another to further collapse canopy structure 10 until each corner support and roof support pair is in the position shown in FIG. 5. In this position, each corner support member 22 and its respective roof support member 40 and cantilever member 70 are in closely spaced generally parallel relationship alongside one another. With reference to FIG. 5 and FIG. 6, it can be appreciated that upper dog leg portion 43 of each inner telescoping member 42 fold to provide an open region 80 to accommodate center post assembly 52, particularly dome-shaped head 59.

To reverse this process and erect canopy structure 10, the user simply moves each of corner support members 22 apart and then raises center post assembly 52 until it passes through plane P and can move up into the fully expanded position with roof support members 40 partially extended. Canopy covering 12 is then positioned over canopy structure 10 with peak 14 oriented on head 59 and with side panels 18 oriented alongside the vertical planes of each scissor assembly 60. To this end, it should be appreciated that side panels 18 and the top panel 16 form a plurality of pocket regions which receive upper end 32 of each corner support member 22. The mating Velcro fasteners on the inside of each of these pockets of side panels 18 are then secured to mating fasteners 35. After securing covering 12, the user then fully extends each roof support member 40 and latches the associated button latches 45 to maintain roof support members 40 in the fully extended position.

Due to the above-described mechanical structure, this latching of roof support members 40 in the fully extended position also prevents corner support members 22 from movement toward the collapsed position. By placing canopy covering 12 on roof support members 40, each of members 40 is placed in compression. This tends to expand, that is, force apart, each of corner support members 42 so that scissor assemblies 60 are placed in tension. Any downwardly directed force on apex 50 tends to slide bracket 34 downwardly due to its interconnection with cantilever 70 but such motion is resisted since scissor assemblies 60 cannot open, since opening them would draw corner support members 22 together. Thus, the mechanical forces of a canopy framework unit is in balance.

Figure 7:
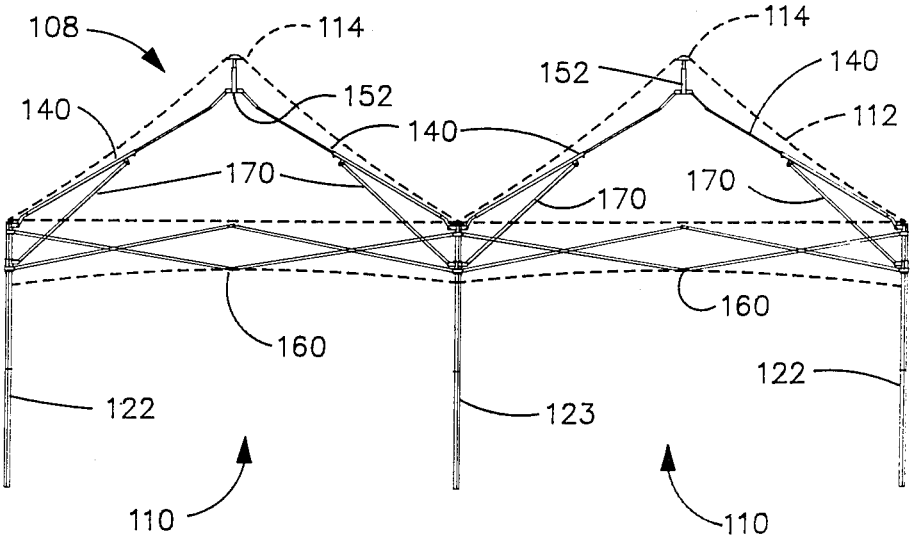
FIG. 7 is a side view in elevation showing a larger canopy framework constructed of two framework units.
Figure 8:
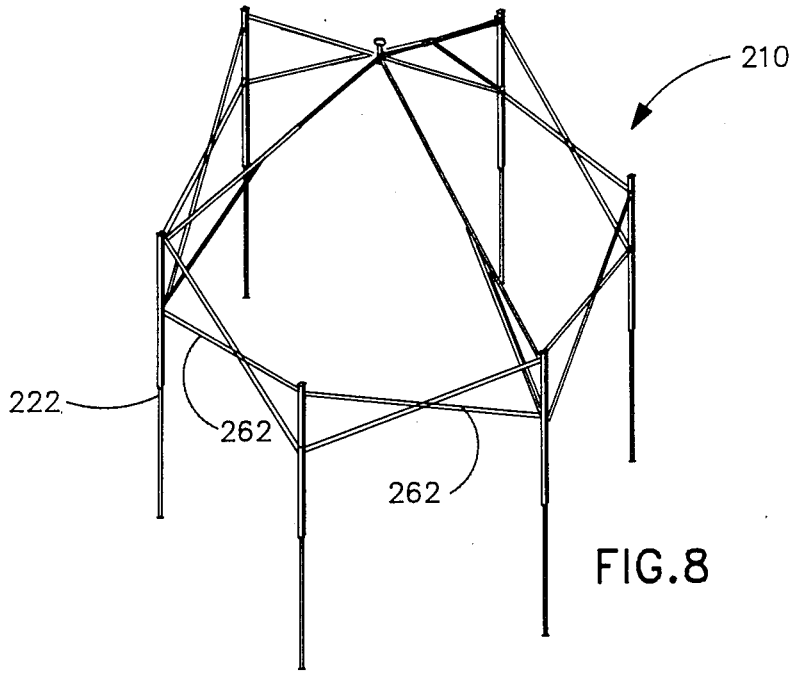
FIG. 8 is a perspective view of a framework unit according to the present invention utilizing a different geometrical configuration.
Figure 9:
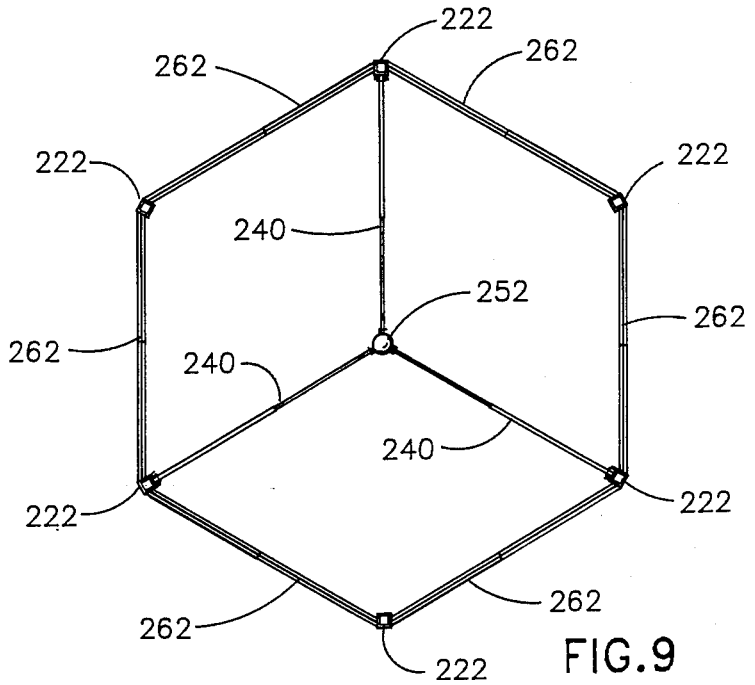
FIG. 9 is a top plan view of the alternate framework unit shown in FIG. 8.

As noted above, it is possible to construct a canopy device in different geometrical configurations. FIGS. 7–9 show two alternate embodiments of the present invention showing different geometrical configurations. For example, FIG. 7 shows a canopy device 108 which is constructed of a pair of canopy structure units 110 which are identical to canopy structure 10, described above. With respect to the embodiment shown in FIG. 7, though, the pair of canopy framework units 110 share a pair of common corner support members, such as corner support member 123. Each corner support member 123 supports a pair of roof support members 140 and a pair of cantilever members 170 on a single slide bracket. Corner support members 122 support a single roof support member 140 and cantilever 170 in a manner similar to that described with respect to the preferred embodiment. A scissor assembly 160 interconnects each corner support member 122 and the corner support member 123. A larger canopy covering 112 (shown in phantom) is then positioned over canopy device 108 with canopy covering 112 having a pair of peaks 114 supported by the pair of center post assemblies 152.

A second alternate embodiment of the present invention is shown in FIGS. 8 and 9. In this embodiment, canopy device 210 is constructed as having a hexagonal configuration formed by six corner support members 222 which are each innerconnected by a single scissor unit 262. It should be noted that, in the embodiment shown in FIGS. 8 and 9, there are six corner support members 222 but these corner support members position three roof support member 240 so that every other corner post 222 mounts a roof support member 240 by means of a cantilever member 270. While in this embodiment, as well as in the preferred embodiment, roof support members are oriented in equiangularly spaced relation around the center post assembly such as center post assembly 252 and project radially outwardly therefrom, the preferred embodiment of the present invention had the corner support members and the roof support members in one-to-one correspondence while the embodiment shown in FIGS. 8 and 9 has corner support members and roof support members in two-to-one correspondence. In all other respects, though, the operation and construction of the alternate embodiment shown in FIGS. 8 and 9 is the same as that described with respect to the preferred embodiment.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A canopy structure adapted to be folded and stored in a collapsed state and erected in an expanded state on a support surface, comprising:

a canopy framework unit including a plurality of upright corner support members each having a bottom end positionable on the support surface and a top end opposite the bottom end, said corner support members oriented alongside one another in the collapsed state and moveable outwardly apart from one another toward the expanded state, a plurality of roof support members pivotally connected to one another on first pivot axes at first ends thereof to define an apex located centrally of said canopy unit, each said roof support member projecting radially outwardly from said apex to terminate at a second end pivotally connected on a second pivot axis to the top end of a respective corner support member whereby said roof support members and said corner support members form the canopy unit may be folded about said first and second pivot axes into the collapsed state with said roof support members and said corner support members oriented in closely spaced relation to one another, each said roof support member including a pair of extendable sections moveable between a retracted state when said canopy structure is in the collapsed state and an extended state when said canopy structure is in the expanded state, said roof support members sized such that said apex is located above a plane defined by said top ends when the canopy structure is in the expanded state and said roof support members are in the extended state, said roof support members each oriented at an acute angle with respect to said plane, constraining and support means for preventing relative movement of said corner support members outwardly apart from one another past the expanded state and for maintaining lateral stability of the corner support members in the expanded state, and latch means associated with each said roof support member for releaseably retaining the extendable sections of each respective roof support member in the extended state to prevent folding of the canopy structure into the collapsed state and whereby the downward force exerted on said apex exerts an outward force component tending to move said corner support members apart from one another against said constraining means; and a flexible covering sized to extend across the canopy framework unit and be supported by said roof support members to form a top for said canopy structure, said covering having perimeter edge portions extending between the top ends of adjacent ones of said corner support members and a central peak portion exerting a downward force on said apex.

2. A canopy structure according to claim 1 wherein said constraining means includes a framework structure extending between top end portions of each pair of adjacent corner support members.

3. A canopy structure according to claim 2 including a slide bracket slideably mounted on each of said corner support members and moveable therealong, and wherein each framework structure is a scissor assembly having one portion pivotally connected to the top end of its associated corner support members and another portion pivotally connected to the slide brackets of its associated corner support members, said scissor assemblies each operative to open and close whereby the associated corner support members are caused to move away from and toward one another.

4. A canopy structure according to claim 3 including a plurality of cantilever members, there being a cantilever member pivotally connected at a first cantilever end to a respective roof support member and pivotally connected at a second cantilever end to the slide bracket on the corner support member to which the respective roof support member is connected whereby the cantilever members help support said roof support members and whereby pivotal movement of said roof support members acts to slide each of said slide brackets along its respective corner support member and correspondingly contract the scissor assemblies associated therewith.

5. A canopy structure according to claim 4 wherein outer end portions of said roof support members adjacent said second ends thereof are each provided with a lower dog leg whereby said corner support members, said cantilever members and said roof support members can be folded in closely spaced parallel relation to one another in the collapsed state.

6. A canopy structure according to claim 1 including a central post assembly pivotally connected to said first ends of said roof support members to define said apex, said central post assembly operative to support the central portion of said flexible covering.

7. A canopy structure according to claim 6 wherein said central post assembly includes a housing and a spring-loaded member biased upwardly against the central portion of said flexible covering.

8. A canopy structure according to claim 6 wherein said central post assembly terminates at an upper end thereof in a dome element operative to abut and support the central portion of said flexible covering.

9. A canopy structure according to claim 8 wherein inner end portions of said roof support members adjacent said first ends thereof are each provided with an upper dog leg whereby said roof support members may be folded alongside and parallel one another around said dome element as said canopy structure is folded into the collapsed state.

10. A canopy structure according to claim 1 wherein said constraining means is formed by said flexible covering.

11. A canopy structure according to claim 10 wherein said flexible covering includes side panels that extend downwardly from said perimeter edge portions, adjacent ones of said side panel portions having vertical edges attached to one another to form corner pocket regions that receive top end portions of said corner support members.

12. A canopy structure according to claim 1 wherein each said roof support member is formed by inner and outer telescoping sections.

13. A canopy structure according to claim 12 wherein the outer telescoping sections are each pivotally connected to a respective corner support member.

14. A canopy structure according to claim 13 wherein said latch means includes a button latch on one of said telescoping sections and a hole sized to receive the button latch on the other of said telescoping sections.

15. A canopy structure according to claim 1 including a plurality of cantilever members, there being a cantilever member pivotally connected at a first cantilever end to each of said roof support members and pivotally connected at a second cantilever end to a slide bracket slideably received on the corner support member associated with the respective roof support member whereby pivotal movement of said roof support members correspondingly slides said slide brackets along said corner support members.

16. A canopy structure according to claim 1 wherein said acute angle is in the range of 15° to 45°.

17. A canopy structure according to claim 16 wherein said acute angle is 30°.

18. A canopy structure according to claim 1 wherein said corner support members are formed by a plurality of telescoping members whereby the height of said corner support members may be selectively adjusted and including releaseable locking means for retaining each said corner support port at the selected height.

19. A canopy structure according to claim 1 including a plurality of canopy framework units interconnected to one another to construct a larger canopy structure, some of said canopy units having common corner support members, said flexible covering extending over the larger canopy structure and having a plurality of peak portions positioned to receive the apices of the canopy units.

20. A canopy structure adapted to be stored in a collapsed state and erected in an expanded state on a generally horizontal support surface, comprising:

an apex portion located on a vertical central axis above said support surface;

a plurality of upright corner support members parallel to and equiangularly spaced around said central axis in parallel relation thereto, said corner support members each having a bottom end positionable on said support surface and a top end opposite said bottom end with said top ends being located in a common plane that is transverse to said central axis, said corner support members oriented in closely spaced relation alongside one another in the collapsed state and moveable outwardly from said central axis and apart from one another toward the expanded state and defining outer corner edges of a structural unit having a selected geometrical configuration in the expanded state;

a plurality of roof support members having first ends pivotally connected on first pivot axes to said apex portion and extending radially outwardly from said central axis at equiangular locations to terminate at second ends, each said second end being pivotally connected on a second pivot axis to the top end of a respective corner support member, each said roof support member including a pair of telescoping sections moveable between a retracted state when the canopy unit is in the collapsed state and an extended state when said canopy unit is in the expanded state, whereby said roof support members and said corner support members which form the canopy unit may be folded about said first and second pivot axes into the collapsed state with said roof support members and said corner support members oriented in closely spaced relation to one another;

a flexible covering sized to extend across and be supported by said roof support members to form a top for said canopy structure, said covering having perimeter edge portions extending between the top ends of adjacent ones of said corner support members;

latch means associated with each said roof support member for releaseably retaining the extendable sections of each respective roof support member in the extended state to prevent folding of the canopy structure into the collapsed state; and constraining and support means acting against said outward force component for preventing relative movement of said corner support members outwardly apart from one another past the expanded state and for stabilizing said corner support members to maintain them in parallel relation to the central axis in the expanded state.

21. A canopy structure according to claim 20 wherein the number of corner support members and the number of roof support members are in one-to-one correspondence.

22. A canopy structure according to claim 20 including a slide bracket slideably mounted on each of said corner support member, said constraining and support means including a scissor assembly having one portion pivotally connected to the top end of its associated corner support members and another portion pivotally connected to the slide brackets of its associated corner support members, said scissor assemblies each operative to expand and contract whereby its associated corner support members are caused to move away from and toward one another.

23. A canopy structure according to claim 22 including a plurality of cantilever members, there being a cantilever member pivotally connected at a first cantilever end to a respective roof support member and pivotally connected at a second cantilever end to the slide bracket on the corner support member to which the respective roof support member is connected whereby pivotal movement of said roof support members acts to slide each of said slide brackets along its respective corner support member and correspondingly contract the scissor assemblies associated therewith.

24. A canopy structure according to claim 23 wherein outer end portions of said roof support members adjacent said second ends thereof are each provided with a dog leg whereby said corner support members, said cantilever members and said roof support members can be folded in closely spaced parallel relation to one another in the collapsed state.

25. A canopy structure according to claim 24 wherein said roof support members sized such that said apex portion is located above said common plane with said roof support members oriented at an acute angle with respect to said common plane when said structural unit is in the expanded state, and including a central post assembly pivotally connected to said first ends of said roof support members to define said apex and operative to support the central portion of said flexible covering whereby the downward force exerted by said central portion on said apex exerts an outward force component tending to move said corner support members apart from one another against said constraining means;

26. A canopy structure according to claim 25 wherein inner end portions of said roof support members adjacent said first ends thereof are each provided with a dog leg whereby said roof support members may be folded alongside and parallel one another around said dome element as said canopy structure is folded into the collapsed state.

27. A canopy structure according to claim 20 including a plurality of canopy framework units interconnected to one another to construct a larger canopy structure, some of said canopy units having common corner support members, said flexible covering extending over the larger canopy structure.

28. A canopy structure adapted to be folded and stored in a collapsed state and erected in an expanded state on a support surface, comprising:

a plurality of upright corner support members each having a bottom end positionable on the support surface and a top end opposite the bottom end with said top ends being located in a common plane, said corner support members oriented alongside one another in parallel relation in the collapsed state and moveable outwardly apart from one another toward the expanded state wherein said corner support members are oriented generally vertically of said support surface;

a plurality of roof support members pivotally connected to one another on first pivot axes at first ends thereof to define an apex portion located centrally of said canpy structure on a vertical central axis when the canopy structure is in the expanded state, said roof support members extending radially outwardly from said apex portion to terminate at second ends, each said second end pivotally connected on a second pivot axis to the top end of a respective corner support member, each said corner support member including an inner telescoping section pivotally connected to the apex portion and an outer telescoping section slideably receiving a respective inner telescoping section and pivotally connected to the top end of a respective corner post member, said inner telescoping sections moveable between a retracted state when the canopy structure is in the collapsed state and an extended state when said canopy structure is in the expanded state whereby said roof support members and said corner support members which form the canopy unit may be folded about said first and second pivot axes into the collapsed state with said roof support members and said corner support members oriented in closely spaced relation to one another, said roof support members sized such that said apex portion is located above said common plane with said roof support members with the roof support members oriented at an acute angle with respect to said common plane when said structural unit is in the expanded state;

a slide bracket slideably mounted on each corner support member;

a scissor assembly interconnecting adjacent ones of said corner support members, each respective scissor assembly oriented in a generally vertical plane and having one portion pivotally connected to the top of its associated corner support members and another portion pivotally connected to the slide brackets of its associated corner support members, said scissor assemblies operative to open when said corner support members move toward the expanded position and to close when said corner support members move toward the collapsed position;

a flexible covering sized to extend across and be supported by said roof support members to form a top for said canopy structure, said covering having perimeter edge portions extending between the top ends of adjacent ones of said corner support members and a central peak portion exerting a downward force on said apex; and latch means on each said roof support means for releaseably retaining said inner and outer telescoping sections in the extended position whereby said canopy structure is maintained in the expanded position with said scissor assemblies are maintained open and under mechanical tension when the canopy structure is in the expanded position.

29. A canopy structure according to claim 28 wherein each of said scissor assembly includes a pair of scissor units connected in end-to-end relation.

30. A canopy structure according to claim 28 including a plurality of cantilever members, there being a cantilever member pivotally connected at a first cantilever end to a respective roof support member and pivotally connected at a second cantilever end to the slide bracket on the corner support member to which the respective roof support member is connected whereby pivotal movement of said roof support members acts to slide each of said slide brackets along its respective corner support member and correspondingly contract the scissor assemblies associated therewith.

31. A canopy structure according to claim 30 including a central post assembly pivotally connected to said first ends of said roof support members to define said apex and operative to support the central portion of said flexible covering.

32. A canopy structure according to claim 31 wherein inner end portions of said roof support members adjacent said first ends thereof are each provided with an upper dog leg whereby said roof support members may be folded alongside and parallel one another around said dome element as said canopy structure is folded into the collapsed state and wherein outer end portions of said roof support members adjacent said second ends thereof are each provided with a lower dog leg whereby said corner support members, said cantilever members and said roof support members can be folded in closely spaced parallel relation to one another in the collapsed state.

33. A canopy structure according to claim 32 wherein said central post assembly terminates at an upper end thereof in a dome element operative to abut and support the central portion of said flexible covering.

34. A canopy structure according to claim 33 wherein said central post assembly includes a housing and a spring-loaded post biased upwardly against the central portion of said flexible covering.

* * * * *

US004779635C1

(12) EX PARTE REEXAMINATION CERTIFICATE (5707th)

United States Patent
Lynch

(10) Number: US 4,779,635 C1
(45) Certificate Issued: Mar. 20, 2007

(54) COLLAPSIBLE CANOPY WITH TELESCOPING ROOF SUPPORT STRUCTURE

(75) Inventor: James P. Lynch, Lakewood, CO (US)

(73) Assignee: Bank of America, Pasadena, CA (US)

Reexamination Request:
No. 90/007,727, Sep. 21, 2005

Reexamination Certificate for:

| | |
|---|---|
| Patent No.: | **4,779,635** |
| Issued: | **Oct. 25, 1988** |
| Appl. No.: | **07/089,441** |
| Filed: | **Aug. 26, 1987** |

(51) Int. Cl.
*E04H 15/34* (2006.01)
*E04H 15/50* (2006.01)

(52) U.S. Cl. ..... 135/97; 135/145; 52/109
(58) Field of Classification Search ..... None
See application file for complete search history.

(56) References Cited

U.S. PATENT DOCUMENTS

| | | | | |
|---|---|---|---|---|
| 1,326,006 A | * | 12/1919 | Sterhardt | 135/139 |
| 1,493,915 A | * | 5/1924 | Baker | 135/146 |
| 1,666,757 A | | 4/1928 | Snyder | |
| 1,853,367 A | * | 4/1932 | Mace | 135/123 |
| 2,530,765 A | | 11/1950 | Greenup | |
| 4,086,931 A | | 5/1978 | Hall | |
| 4,607,656 A | | 8/1986 | Carter | |
| 4,641,676 A | | 2/1987 | Lynch | |

* cited by examiner

*Primary Examiner*—Peter C. English

(57) ABSTRACT

A canopy structure is provided and includes a framework unit and a flexible covering. The framework unit is formed by a plurality of upright corner members and a plurality of roof support members that are pivotally connected at the top ends of the corner members and, in an erected position, extend upwardly and inwardly to a central apex where they are pivotally connected to one another. The roof support members are formed of extendable sections which preferably telescope with respect to one another so that the framework unit may move into a collapsed state with the corner support and roof support members oriented in closely spaced, parallel relation. Latches are provided to prevent the framework unit from collapsing from the erected position. Constraining and support structure, preferably in the form of scissor assemblies, interconnect adjacent corner support members to prevent them from moving apart past the erect state. The scissor assemblies have one portion pivotally connected to the tops of its associated corner supports and another portion pivotally connected to slide brackets on its associated corner support member. A cantilever member interconnects each roof support member and the slide bracket on its associated corner support member. The central apex may include a spring biased central post to support the peak of the covering placed on the framework unit. Several framework units may be formed together into a larger canopy structure.

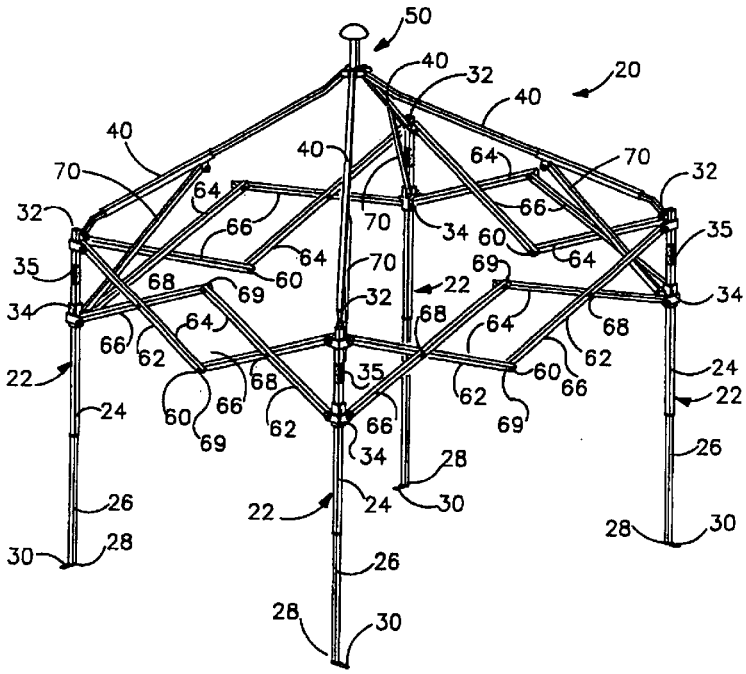

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 20–34 is confirmed.

Claims 1, 4 and 15 are determined to be patentable as amended.

Claims 2, 3, 5–14, and 16–19, dependent on an amended claim, are determined to be patentable.

New claims 35–37 are added and determined to be patentable.

1. A canopy structure adapted to be folded and stored in a collapsed state and erected in an expanded state on a support surface, comprising:

a canopy framework unit including a plurality of upright corner support members each having a bottom end positionable on the support surface and a top end opposite the bottom end, said corner support members oriented alongside one another in the collapsed state and moveable outwardly apart from one another toward the expanded state, a plurality of roof support members pivotally connected to one another on first pivot axes at first ends thereof to define an apex located centrally of said canopy unit, each said roof support member projecting radially outwardly from said apex to terminate at a second end pivotally connected on a second pivot axis to the top end of a respective corner support member whereby said roof support members and said corner support members form the canopy unit may be folded about said first and second pivot axes into the collapsed state with said roof support members and said corner support members oriented in closely spaced relation to one another, each said roof support member including a pair of extendable sections moveable between a retracted state when said canopy structure is in the collapsed state and an extended state when said canopy structure is in the expanded state, said roof support members sized such that said apex is located above a plane defined by said top ends when the canopy structure is in the expanded state and said roof support members are in the extended state, said roof support members each oriented at an acute angle with respect to said plane, constraining and support means for preventing relative movement of said corner support members outwardly apart from one another past the expanded state and for maintaining lateral stability of the corner support members in the expanded state, and latch means associated with each said roof support member for releaseably retaining the extendable sections of each respective roof support member in the extended state to prevent folding of the canopy structure into the collapsed state and whereby the downward force exerted on said apex exerts an outward force component tending to move said corner support members apart from one another against said constraining means; [and]

*at least one cantilever member pivotally connected to at least one roof support member and pivotally connected to a slide bracket slideably received on a respective corner suppport member associated with said at least one roof support member whereby pivotal movement of said roof support members correspondingly slides said slide bracket along said corner support member;* and a flexible covering sized to extend across the canopy framework unit and be supported by said roof support members to form a top for said canopy structure, said covering having perimeter edge portions extending between the top ends of adjacent ones of said corner support members and a central peak portion exerting a downward force on said apex.

4. A canopy structure [according to claim 3 including] *adapted to be folded and stored in a collapsed state and erected in an expanded state on a support surface, comprising:*

*a canopy framework unit including a plurality of upright corner support members each having a bottom end positionable on the support surface and a top end opposite the bottom end, said corner support members oriented alongside one another in the collapsed state and moveable outwardly apart from one another toward the expanded state, a plurality of roof support members pivotally connected to one another on first pivot axes at first ends thereof to define an apex located centrally of said canopy unit, each said roof support member projecting radially outwardly from said apex to terminate at a second end pivotally connected on a second pivot axis to the top end of a respective corner support member whereby said roof support members and said corner support members form the canopy unit may be folded about said first and second pivot axes into the collapsed state with said roof support members and said corner support members oriented in closely spaced relation to one another, each said roof support member including a pair of extendable sections moveable between a retracted state when said canopy structure is in the collapsed state and an extended state when said canopy structure is in the expanded state, said roof support members sized such that said apex is located above a plane defined by said top ends when the canopy structure is in the expanded state and said roof support members are in the extended state, said roof support members each oriented at an acute angle with respect to said plane, constraining and support means for preventing relative movement of said corner support members outwardly apart from one another past the expanded state and for maintaining lateral stability of the corner support members in the expanded state, and latch means associated with each said roof support member for releaseably retaining the extendable sections of each respective roof support member in the extended state to prevent folding of the canopy structure into the collapsed state and whereby the downward force exerted on said apex exerts an outward force component tending to move said corner support members apart from one another against said constraining means, wherein said constraining means includes a framework structure extending between top end portions of each pair of adjacent corner support members;*

*a flexible covering sized to extend across the canopy framework unit and be supported by said roof support*

*members to form a top for said canopy structure, said covering having perimeter edge portions extending between the top ends of adjacent ones of said corner support members and a central peak portion exerting a downward force on said apex;*

*a slide bracket slideably mounted on each of said corner support members and moveable therealong, and wherein each framework structure is a scissor assembly having one portion pivotally connected to the top end of its associated corner support members and another portion pivotally connected to the slide brackets of its associated corner support members, said scissor assemblies each operative to open and close whereby the associated corner support members are caused to move away from and toward one another; and* a plurality of cantilever members, there being a cantilever member pivotally connected at a first cantilever end to a respective roof support member and pivotally connected at a second cantilever end to the slide bracket on the corner support member to which the respective roof support member is connected whereby the cantilever members help support said roof support members and whereby pivotal movement of said roof support members acts to slide each of said slide brackets along its respective corner support member and correspondingly contract the scissor assemblies associated therewith.

15. A canopy structure [according to claim 1 including] *adapted to be folded and stored in a collapsed state and erected in an expanded state on a support surface, comprising:*

*a canopy framework unit including a plurality of upright corner support members each having a bottom end positionable on the support surface and a top end opposite the bottom end, said corner support members oriented alongside one another in the collaped state and moveable outwardly apart from one another toward the expanded state, a plurality of roof support members pivotally connected to one another on first pivot axes at first ends thereof to define an apex located centrally of said canopy unit, each said roof support member projecting radially outwardly from said apex to terminate at a second end pivotally connected on a second pivot axis to the top end of a respective corner support member whereby said roof support members and said corner support members form the canopy unit may be folded about said first and second pivot axes into the collapsed state with said roof support members and said corner support members oriented in closely spaced relation to one another, each said roof support member including a pair of extendable sections moveable between a retracted state when said canopy structure is in the collapsed state and an extended state when said canopy structure is in the expanded state, said roof support members sized such that said apex is located above a plane defined by said top ends when the canopy structure is in the expanded state and said roof support members are in the extended state, said roof support members each oriented at an acute angle with respect to said plane, constraining and support means for preventing relative movement of said corner support members outwardly apart from one another past the expanded state and for maintaining lateral stability of the corner support members in the expanded state, and latch means associated with each said roof support member for releaseably retaining the extendable sections of each respective roof support member in the extended state to prevent folding of the canopy structure into the collapsed state and whereby the downward force exerted on said apex exerts an outward force component tending to move said corner support members apart from one another against said constraining means;*

*a flexible covering sized to extend across the canopy framework unit and be supported by said roof support members to form a top for said canopy structure, said covering having perimeter edge portions extending between the top ends of adjacent ones of said corner support members and a central peak portion exerting a downward force on said apex; and* a plurality of cantilever members, there being a cantilever member pivotally connected at a first cantilever end to each of said roof support members and pivotally connected at a second cantilever end to a slide bracket slideably received on the corner support member associated with the respective roof support member whereby pivotal movement of said roof support members correspondingly slides said slide brackets along said corner support members.

*35. A canopy structure according to claim 1 wherein the at least one cantilever member is pivotally connected to the associated slide bracket at a pivot point that is adjacent to the slide bracket.*

*36. A canopy structure according to claim 4 wherein the second cantilever end of each cantilever member is pivotally connected to the associated slide bracket as a pivot point that is adjacent to the slide bracket.*

*37. A canopy structure according to claim 15 wherein the second cantilever end of each cantilever member is pivotally connected to the associated slide bracket at a pivot point that is adjacent to the slide bracket.*

* * * * *